United States Patent [19]

Young et al.

[11] 4,284,389

[45] Aug. 18, 1981

[54] INPUT TORQUE CONTROL SYSTEM FOR A VARIABLE DISPLACEMENT PUMP

[75] Inventors: John E. G. Young, Watertown; Donald R. Schneckenburger, Chaumont, both of N.Y.

[73] Assignee: General Signal Corporation, Stamford, Conn.

[21] Appl. No.: 69,478

[22] Filed: Aug. 24, 1979

[51] Int. Cl.[3] ..... F04B 49/00

[52] U.S. Cl. ..... 417/218; 60/451

[58] Field of Search ..... 417/218–222; 91/506; 60/445, 451

[56] References Cited

U.S. PATENT DOCUMENTS

| | | | |
|---|---|---|---|
| 3,669,570 | 6/1972 | Himmler | 417/222 |
| 3,985,469 | 10/1976 | Ohta | 417/222 |

FOREIGN PATENT DOCUMENTS

| | | | |
|---|---|---|---|
| 43-3927 | 8/1968 | Japan | 417/222 |

*Primary Examiner*—Carlton R. Croyle
*Assistant Examiner*—Edward Look
*Attorney, Agent, or Firm*—Harold S. Wynn; Jeffrey S. Mednick; Thomas R. FitzGerald

[57] ABSTRACT

A variable displacement pump has a displacement control cam operably connected to a displacement control cylinder within a pump housing and a pressure and flow sensitive compensating valve is connected to the pump housing for regulating output of the pump. The compensating valve is secured to the pump housing through a spacer block. A lever is disposed partly in the spacer block and partly in a housing of the compensating valve responsive to positioning of the pump cam through a mechanical connection for actuating a sleeve in the compensating valve to incorporate torque-limiting feedback regulation of the pump. An adjustment is operable from an outer surface of the spacer block to limit torsional operation of the lever about a pivot point.

4 Claims, 4 Drawing Figures

INPUT TORQUE CONTROL SYSTEM FOR A VARIABLE DISPLACEMENT PUMP

REFERENCE TO PRIOR PATENTS

Prior U.S. Pat. Nos. 3,669,570 and 3,985,469 are herein incorporated by reference for their disclosure of pertinent background material.

BACKGROUND

This invention relates to an input torque control system for a variable displacement pump, and while the invention is subject to a wide range of applications, a preferred embodiment of the invention will be particularly described as applied to input torque control of a cylindrical variable displacement pump.

Input torque control has the advantage of improved efficiency of a hydraulic system, particularly as it eliminates the corner horsepower requirement. It is known to provide input torque control for a pressure compensator in a hydraulic control system by causing a pressure compensator sleeve to be axially operable in accordance with mechanically linking the sleeve with a pump displacement control cam. This can be done so as to select desired characteristics by including in the linkage a selected conically shaped cam to vary the ratio of movement of the compensator sleeve as desired relative to the positioning of a pump displacement control cam. Systems of this nature are known, for example in the prior U.S. Pat. Nos. 3,669,570 and 3,985,469. In the U.S. Pat. No. 3,669,570, a compensator sleeve has a cam follower formed on one end thereof which selectively bears against one of two peripheral cam surfaces on a lever that is described as being subject to actuation in accordance with the positioning of a pump displacement control cam. One of the cam surfaces is shaped for defining a predetermined regulated level corresponding to a desired constant power output. The second cam surface is a pressure limit control. In order to select a different characteristic output of the pump, it would be necessary to substitute a lever having a different cam structure.

An object of the present invention is to provide an input torque system for a variable displacement pump which substantially obviates one or more of the limitations and disadvantages of the described prior art systems.

Another object of the present invention is to simplify input torque control systems for variable delivery pumps by providing an external adjustment for designating a desired pressure limit control for a pump.

Another object of the present invention is to improve the efficiency and reduce the cost of input torque control systems for variable displacement pumps.

Other objects, purposes and characteristic features of the present invention will be in part obvious from the accompanying drawings, and in part point out as the description of the invention progresses.

SUMMARY

The system, according to the present invention, provides an input torque control system for a variable displacement pump having a displacement control cam operably connected to a displacement control cylinder within a pump housing. A pressure and flow sensitive compensating valve is connected to the pump housing for regulating output of the pump.

A compensating valve housing is connected to the pump through a spacer block. The valve housing contains an axially operable valve sleeve and a spool operable axially within the sleeve, the sleeve spool being spring biased axially in opposite directions.

A lever is disposed partly in the spacer block and partly in the valve housing having a first arm operably engaging the valve sleeve, a second arm operably engaging feedback linkage connected to the displacement control cam, and a third arm having its movement limited by a pressure limit adjustment screw operable within the spacer block.

For a better understanding of the present invention, together with other and further objects thereof, reference is had to the following description, taken in connection with the accompanying drawings, while its scope will be pointed out in the attending claims.

DESCRIPTION OF THE DRAWINGS

With reference to FIG. 1, a variable displacement pump 10 includes a displacement control cam 11 that is operably connected to a displacement control cylinder 12 within a pump housing 13. A pressure and flow sensitive compensating valve 14 has a housing 15 that is connected to a surface 16 of the pump 10 through a spacer block 17.

Figure 1:
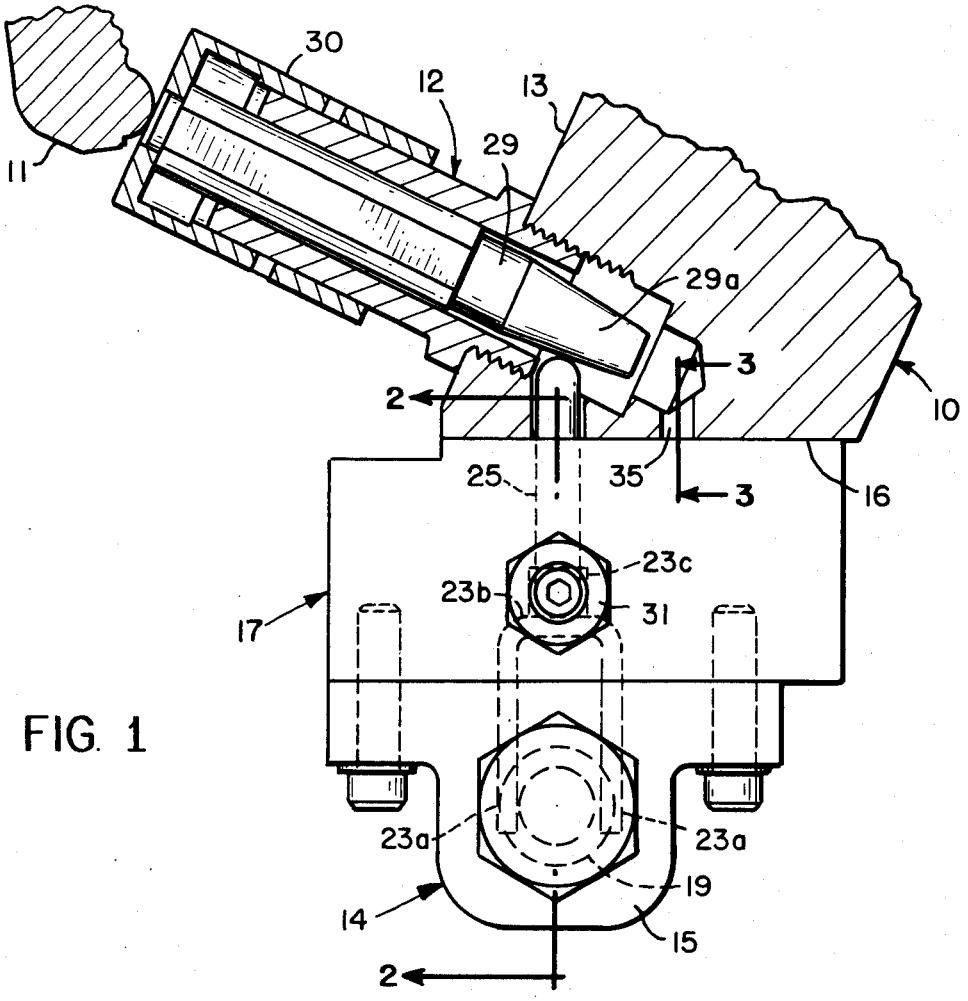
FIG. 1 is a plan view, partly in cross section, of a pump and compensator valve assembly according to a preferred embodiment of the present invention.

The valve housing 15 has a stepped bore 18 for receiving an axially slidable valve sleeve 19. A valve spool 20 is axially operable within the valve sleeve 19. A spring 21 biases the sleeve 19 to the right, and a spring 22 biases the spool to the left.

A lever 23 is disclosed partly in the spacer block 17 and partly in the valve 14. The lever 23 is operable about a pivot point 24. A first arm **23*a* extends to engage the sleeve 19; a second arm 23*b* extends to engage a feedback pin 25; and a third arm 23*c* extends to at times contact an adjustable stop pin 26. The pin 26 is a pressure limit adjustment screw for limiting output pressure of the pump 10**.

The lever 23 has its first arm **23*a* formed in a bifurcated manner, the outer ends of which are circular in shape to provide point contacts with sides of an annular recess 27 in the sleeve 19. The operating pin 25 for the lever 23 is axially operable in a bore 28 in the spacer block 17; pin 25 being actuated by a conical portion 29*a* at the right hand end of the piston 29. The taper of this portion of the piston 29 determines the degree of input torque control provided. The piston 29 is connected to a conventional sleeve 30 for axial movement to drive the displacement cam 11 in accordance with control cylinder pressure output of the compensating valve 14**.

The adjustment pin 26 has its left hand end threaded into a bore in the spacer block 17, and has a lock nut 31 that can be set to hold any adjustment that it made by the rotation of the pin 26. Also, a conventional threaded adjustment spring seat 32 is provided at the right hand end of the compensator valve 14 for adjustment for the effective force of spring 22.

Figure 3:
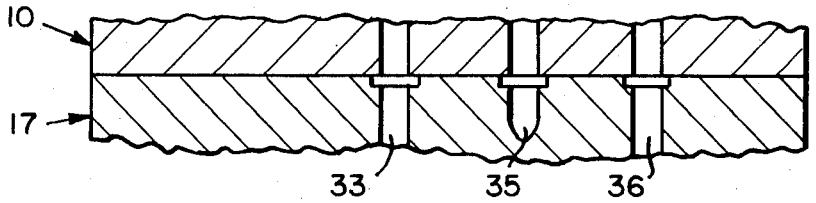
FIG. 3 is an elevational sectional view taken along line 3—3 of FIG. 1.
Figure 2:
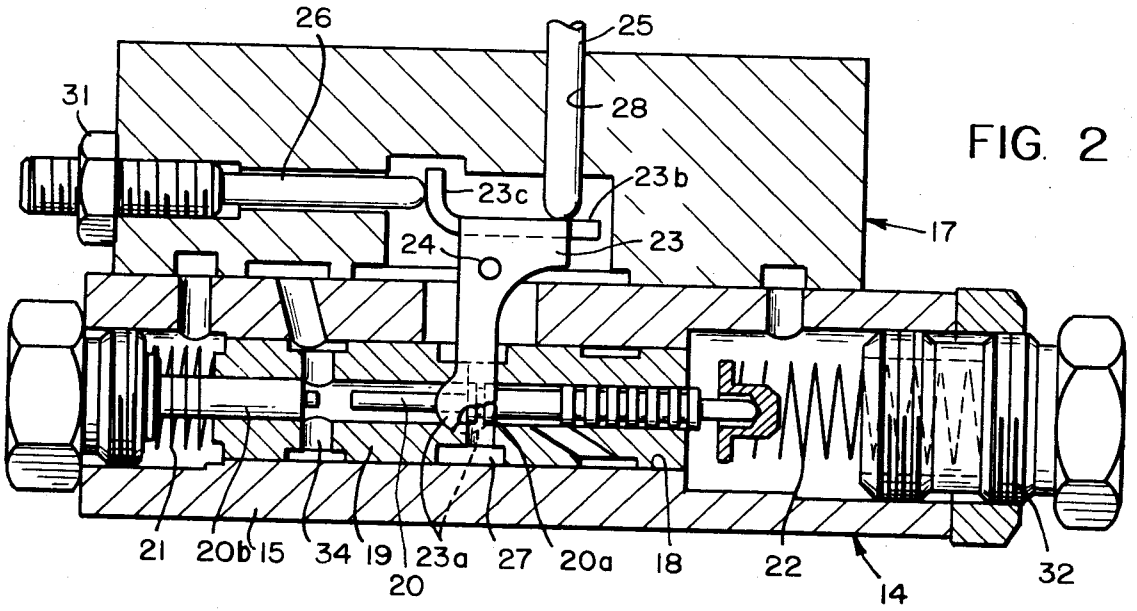
FIG. 2 is an elevational sectional view of a compensator valve and spacer block taken along the line 2—2 of FIG. 1.

Passages are formed in the spacer block 17 for communication of fluid between the compensating valve and the pump 10 as is illustrated in FIG. 3. Passage 33 in this figure connects high pressure fluid from the pump to a passage 34 for actuating the valve spool 20 in a right hand direction, away from a stop spool 20*b* and in opposition to the spring 22. Fluid from this passage is at times also delivered past a land 20*a* in spool 20 (partly obscured by the end portion of lever 23*a* in FIG. 2) to the control cylinder 12 through passage 35 for actuating cam 11 to destroke the pump 10. For permitting actuation of the control piston 29 in the opposite direction, the actuation of the same land of spool 20 in the opposite direction is effective to vent the control cylinder 12 to a pump case input passage 36. The passage also vents the spring housings at the opposite end of the compensating valve 14.

Figure 4:
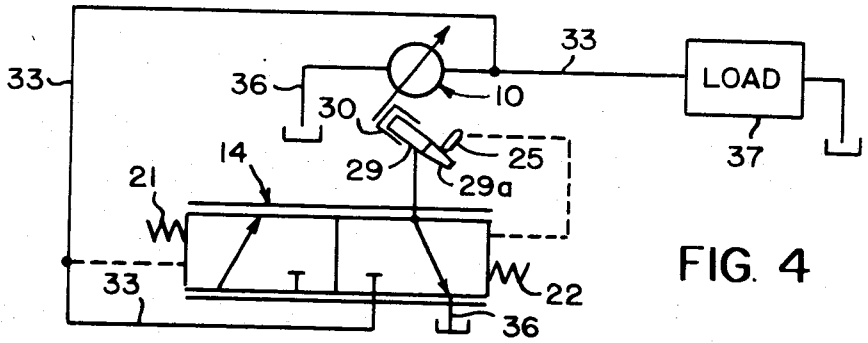
FIG. 4 is a schematic diagram illustrating typical connections of fluid passageways according to the preferred embodiment of FIG. 1.

With reference to FIG. 4, the above-described connections for the input torque control system that has been described is illustrated schematically wherein a load 37 can be driven by delivery of fluid in passage 33 from the pump 10, the flow and pressure of hydraulic fluid in passage 33 being governed in accordance with actuation of the feedback pin 25 that opposes spring 21 in the compensator valve 14 to govern the compensator valve 14 in a manner to obtain best performance from a prime mover (not shown). This permits high pump displacement at low load levels, and reduced pump displacement at high load levels such as to prevent overload of the prime mover, the maximum pressure of the system being determined by limitation of rotation of the lever 23 by the adjustment pin 26.

Adjustment of the load of spring 22 by the adjustment of spring seat 32 can determine the pressure at which the pump displacement starts to reduce with the slope of a straight line cutoff curve determined by the spring rate wherein pump discharge flow is plotted against pump discharge pressure. A preferable adjustment of spring 22 is so that the slope of the straight line characteristic provides minimum deviation from a true horsepower curve.

After spring 22 has been adjusted as described above, a full cutoff pressure setting can be established by adjustment of pin 26 to selectively limit rotation of lever 23.

Having thus described an input torque control system for a variable displacement pump as a preferred embodiment of the present invention, it is to be understood that various modifications and alterations may be made to the specific embodiment shown without departing from the spirit or scope of the invention.

We claim:

1. An input torque control system for a variable displacement pump including a displacement control cam operably connected to displacement control cylinder means within a pump housing, and pressure and flow sensitive compensating valve means connected to the pump housing for regulating output of the pump, wherein improved compensating valve means comprises:

(a) valve housing means secured to a surface of the pump housing through spacer means;

(b) the valve housing means having a valve sleeve operable axially in a bore of the housing and a spool valve operable axially within the sleeve;

(c) spring biasing means for axially biasing the sleeve and the spool valve in opposite directions;

(d) lever means for axially operating the sleeve disposed in part in the valve housing means and in part in the spacer means having a central pivot from which (1) a first arm extends to engage the sleeve, (2) a second arm extends to engage feedback means positioned by said displacement control cam, and (3) a third arm extends to at times contact an adjustable stop means for limiting output pressure of the pump; and (e) means including the spool valve for selectively delivering output of the pump to the control cylinder means or output of the control cylinder means to a tank in accordance with pump output pressure sensed by the spool valve.

2. An input torque control system for a variable displacement pump according to claim 1 wherein the displacement control cylinder means comprises;

(a) a cup-shaped sleeve bearing against the displacement control cam and slidable longitudinally on the outside of a fixed cylinder, (b) a piston within the cylinder having one end bearing against the bottom of the sleeve and having its other end conically shaped, and (c) push rod means having one end contacting the conically shaped portion and its other contacting the second arm of the lever means for axially operating the valve sleeve in accordance with axial movement of the piston in response to a change in the position of the displacement control cam.

3. An input torque control system for a variable displacement pump according to claim 1 or claim 2 wherein the first arm of the lever means terminates in a circular-shaped end portion for actuating the valve sleeve.

4. An input torque control system for a variable displacement pump according to claim 1 or claim 2 wherein the adjustable stop means comprises a longitudinally adjustable stop pin means within a bore of the spacer means having one end disposed opposite the third arm of the lever means and its opposite end extending outside of the spacer means to permit longitudinal adjustment of the stop pin means without requiring any diassembly of the compensating valve means.

* * * * *